US006955618B1

(12) United States Patent
Mitchell

(10) Patent No.: US 6,955,618 B1
(45) Date of Patent: Oct. 18, 2005

(54) ADJUSTABLE TENSION STRINGED RACQUET

(76) Inventor: Herman R. Mitchell, 4930 Strathaven Dr., Dayton, OH (US) 45424

( * ) Notice: Subject to any disclaimer, the term of this patent is extended or adjusted under 35 U.S.C. 154(b) by 0 days.

(21) Appl. No.: 10/896,395

(22) Filed: Jul. 22, 2004

(51) Int. Cl.[7] ..... A63B 51/12
(52) U.S. Cl. ..... 473/534
(58) Field of Search ..... 473/534, 540, 473/542, 524, 549, 538, 537

(56) References Cited

U.S. PATENT DOCUMENTS 2,089,118 A * 8/1937 Fritsch ..... 473/534
4,203,597 A * 5/1980 Reedhead et al. ..... 473/534
4,322,076 A * 3/1982 Bertram et al. ..... 473/537
4,613,138 A * 9/1986 Haythornthwaite ..... 437/534
4,754,968 A * 7/1988 Fischer ..... 473/534
4,765,621 A * 8/1988 Game ..... 473/534
5,919,104 A * 7/1999 Mortvedt et al. ..... 437/540
6,796,916 B1 * 9/2004 Filippini ..... 473/540
6,852,048 B1 * 2/2005 Filippini ..... 473/539

* cited by examiner

*Primary Examiner*—Raleigh W. Chiu
(74) *Attorney, Agent, or Firm*—Mark A. Navarre

(57) ABSTRACT

A stringed racquet includes a built-in, user-adjustable mechanism for changing the tension of the strings. The user-adjustable mechanism is disposed in a cavity within the handle of the racquet, and includes a mandrel over which at least some of the vertical strands of string are looped. A wishbone bracket secured to the mandrel is axially adjustable within the handle to raise or lower the tension in the vertical strands looped over the mandrel, after which the tension becomes evenly distributed over the entire string.

3 Claims, 1 Drawing Sheet

ADJUSTABLE TENSION STRINGED RACQUET

TECHNICAL FIELD

The present invention relates to stringed racquets for use in sports such as tennis, racquetball, and the like, and more particularly to a racquet that having a built-in, user-adjustable mechanism for changing the tension of the strings.

BACKGROUND OF THE INVENTION

With currently available racquets, the string tension is set at the factory, and is not adjustable by the user. If the user desires to change the string tension, the original string must be removed and replaced with a new string, using special fixtures and tensioning weights. Since installing a new string can be a difficult and time consuming process, most users would benefit from a racquet having easily adjustable string tension.

SUMMARY OF THE INVENTION

The present invention is directed to an improved stringed racquet including a built-in, user-adjustable mechanism for changing the tension of the strings. The user-adjustable mechanism is disposed in a cavity within the handle of the racquet, and includes a mandrel over which at least some of the vertical strands of string are looped. A wishbone bracket secured to the mandrel is axially adjustable within the handle to raise or lower the tension in the vertical strands looped over the mandrel, after which the tension becomes evenly distributed over the entire string.

BRIEF DESCRIPTION OF THE DRAWINGS

The present invention will now be described, by way of example, with reference to FIG. 1, which depicts a racquetball racquet equipped with a user-adjustable mechanism according to this invention for changing the racquet string tension;

DESCRIPTION OF THE PREFERRED EMBODIMENT

Figure 1:
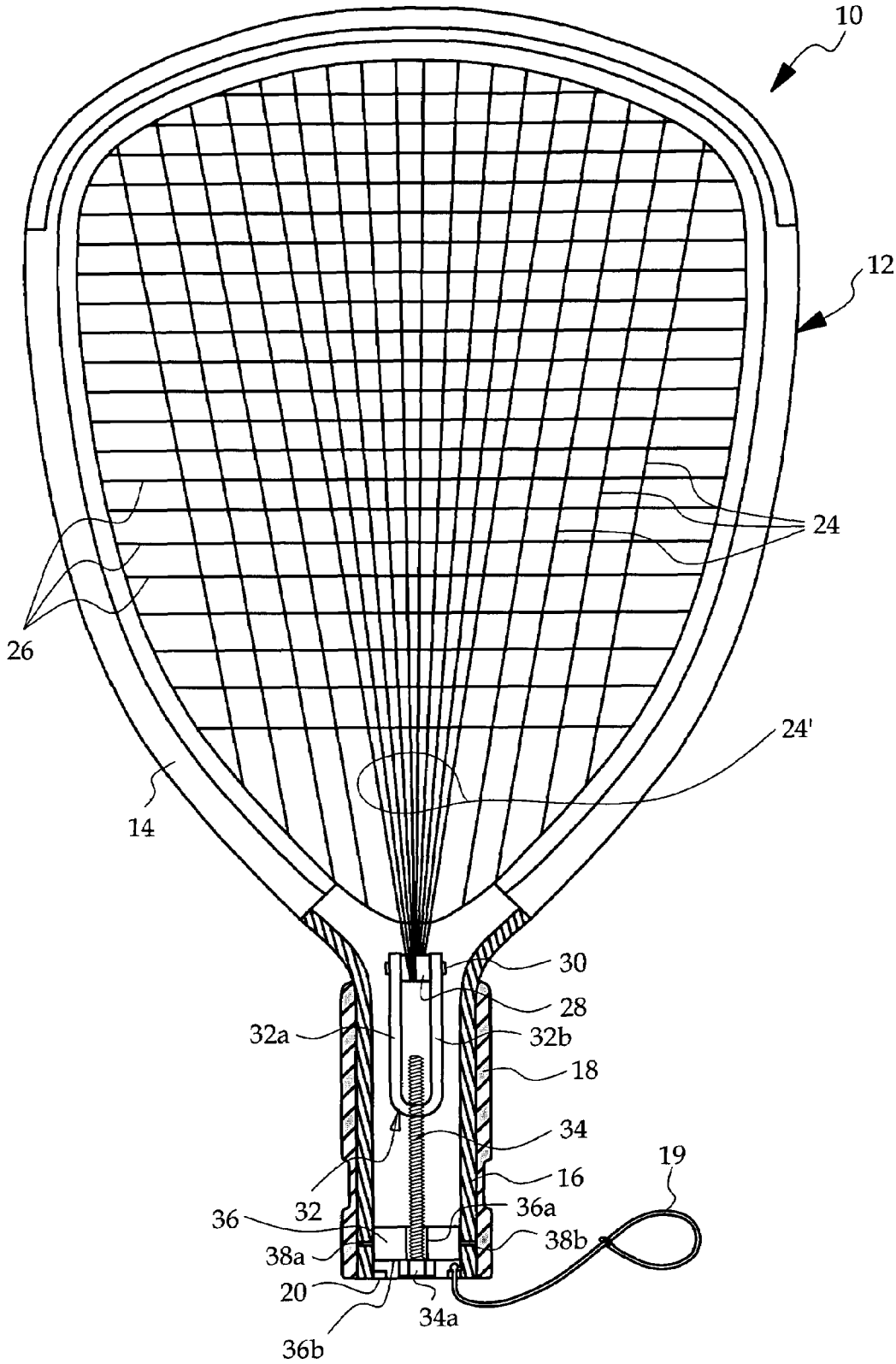

Referring to FIG. 1, the present invention is described herein primarily in the context of a racquetball racquet 10. However, it will be understood that the invention is also applicable to other types of stringed racquets such as tennis racquets, squash racquets, and so forth. The frame 12 of racquet 10 is manufactured as a single piece, and includes a basket portion 14 and a handle 16. A rubber or plastic grip 18 is fitted to the exterior periphery of handle 16, and a lanyard 19 is tied to an end-cap 20 of handle 16. The basket portion 14 of frame 12 has a number of drilled openings about its periphery, and the string is laced through the openings in a standard way to define a number of vertical strands 24 that extend more or less parallel to a longitudinal axis of handle 12, and a number of horizontal strands 26 that extend perpendicular to the handle axis.

Racquets of the above-described type are available from several sources, including EF Composite Technologies, L.P., San Diego, Calif.; see for example, the U.S. Pat. No. 5,919,104 to Mortvedt et al., issued on Jul. 6, 1999. As illustrated in the aforementioned patent, at least some of the vertical strands 24 can be looped around a mandrel secured to the frame 12 within the handle 16 instead of being laced through openings in the basket portion 14 in order to increase the effective length of such strands. In the racquet 10 of the present invention, at least some of the vertical strands (i.e., those designated by the reference numeral 24' in FIG. 1) are also looped around a string support element such as mandrel 28, only in this case, the mandrel 28 is adjustably supported within the handle 16 instead of being rigidly fastened to the handle 16. Referring to FIG. 1, the mandrel 28 rides on an axle 30, and the ends of axle 30 are secured in the opposing arms 32*a*, 32*b* of a wishbone bracket 32. The wishbone bracket 32, which may be formed of aluminum for example, extends into the handle 16 and includes a threaded opening for receiving a threaded adjustment element such as a bolt 34. The bolt 34 passes through an opening 36*a* in an anchor block 36, and the anchor block 36 is fastened to the handle 16 of frame 12 by the pins 38*a*, 38*b*. The head 34*a* of bolt 34 seats against the outboard face 36*b* of anchor block 36 and is accessible by a user-manipulated nut driver tool for the purpose of rotating the bolt 34. When the bolt 34 has the customary right-hand thread configuration, rotating the bolt head 34*a* clockwise acts to draw the wishbone bracket 32 axially deeper into the handle 16 to increase the string tension of racquet 10; rotating the bolt head 34*a* counter-clockwise of course produces the opposite effect.

Due to friction, rotating the bolt head 34*a* has a tendency to produce similar rotation of the wishbone bracket 32 and mandrel 28. In the illustration of FIG. 1, for example, the wishbone bracket 32 and mandrel 28 are rotated approximately 90° in the clockwise direction (relative to the minimum tension orientation) due to clockwise rotation of the bolt head 34*a*. However, the string tension produces a restoring torque that tends to rotate the bracket 32 and mandrel 28 back to the minimum tension orientation as soon as the racquet is put into use.

Although the vertical strands 24' are looped over the mandrel 28, their effective length remains similar to that of a racquet constructed according to the aforementioned U.S. Pat. No. 5,919,104 since the wishbone bracket 32 is allowed to pivot about the head 34*a* of bolt 34. This pivoting actually improves the feel of the racquet 10 by absorbing shock and amplifying the rebound speed of a ball from the string face of the racquet.

When installing a new string on the racquet 10, the bolt 34 is rotated counter-clockwise so that the mandrel 28 extends into the basket portion 14 of frame 12, and the central vertical strands 24' are looped over the mandrel as shown instead of being routed through the drilled frame openings. The string can be loosely tensioned during this process, and then properly tensioned by clockwise rotation of the bolt 34 once the string is fully routed and tied off. Although the tension produced by the clockwise rotation of the bolt 34 is initially concentrated in the central strands 24', using the racquet or jarring the racquet frame 12 causes the strands to shift in a way that evenly distributes the tension.

In summary, the racquet of the present invention affords a user the ability to easily and quickly adjust the string tension to suit his or her preference. And should a string break during usage of the racquet, the racquet may be restrung and re-tensioned without requiring any special equipment, weights or fixtures. Alternately, the racquet may be temporarily patched by loosening the adjustment mechanism, knotting the broken string or adding in a short additional strand of string to fortify a weak area, and re-tensioning the strings as described above.

While the invention has been described in reference to the illustrated embodiment, it should be understood that various modifications in addition to those mentioned above will occur to persons skilled in the art. For example, the mandrel 28 can be provided with a hook or T-bar over which the strings are looped, more than one mandrel may be mounted on the wishbone bracket 32, the handle 16 may include a shaped cavity for limiting rotation of the wishbone bracket 32, more or fewer vertical strands 24' may be looped over the mandrel 28, and so on. Accordingly, it will be understood that racquets incorporating these and other modifications may fall within the scope of this invention, which is defined by the appended claims.

What is claimed is:

1. A stringed racquet, comprising:

a frame including a basket portion and a depending hollow handle having a longitudinal axis;

a tensioning device including a string support element and a wishbone bracket having arms that support said string support element;

a string routed through said basket portion, and over said string support element;

an anchor member secured to said frame within said handle; and an adjustment bolt having a threaded portion threaded into said wishbone bracket and a head portion seated on an outboard face of said anchor member such that said wishbone bracket is allowed to pivot about the head portion of said bolt, said bolt being rotatable for changing the position of said tensioning device with respect to said anchor member to adjust a tension of said string.

2. The stringed racquet of claim 1 wherein said tensioning device has an axis that coincides with the longitudinal axis of said handle, and said adjustment element draws the tensioning device into said handle to increase said tension.

3. The stringed racquet of claim 1, wherein said adjustment bolt and at least a portion of said tensioning device are disposed within said handle.

* * * * *